US007007949B2

(12) United States Patent
Gilbertson

(10) Patent No.: US 7,007,949 B2
(45) Date of Patent: Mar. 7, 2006

(54) MULTIPLE SUPPLY FILM TRANSPORT MECHANISM

(75) Inventor: James R. Gilbertson, Oakdale, MN (US)

(73) Assignee: Eastman Kodak Company, Rochester, NY (US)

( * ) Notice: Subject to any disclaimer, the term of this patent is extended or adjusted under 35 U.S.C. 154(b) by 136 days.

(21) Appl. No.: 10/621,778

(22) Filed: Jul. 17, 2003

(65) Prior Publication Data

US 2005/0012262 A1 Jan. 20, 2005

(51) Int. Cl.
*B65H 5/00* (2006.01)

(52) U.S. Cl. ..... 271/225; 271/264; 271/9.13

(58) Field of Classification Search ..... 271/225, 271/264, 9.11, 9.13; 396/612, 564; 355/27, 355/28, 29; 378/173, 172, 207
See application file for complete search history.

(56) References Cited

U.S. PATENT DOCUMENTS

| | | | | |
|---|---|---|---|---|
| 4,804,175 | A * | 2/1989 | Grandjean | 271/225 |
| 4,879,578 | A * | 11/1989 | Hisajima et al. | 399/195 |
| 4,958,822 | A * | 9/1990 | Rutishauser et al. | 271/9.11 |
| 6,241,245 | B1 * | 6/2001 | Hollar et al. | 271/314 |
| 2003/0011126 | A1 * | 1/2003 | Miyazawa | 271/264 |

* cited by examiner

*Primary Examiner*—Donald P. Walsh
*Assistant Examiner*—Kaitlin Joerger
(74) *Attorney, Agent, or Firm*—William F. Noval

(57) ABSTRACT

Apparatus for changing the direction of transport of a sheet by about 75° to about 90° comprising: a first flat guide for contacting the leading edge of a sheet transported along a path to change its direction of transport by an acute angle; a second flat or concavely curved guide spaced from the first guide for contacting the leading edge of the sheet to change to direction of transport by an acute angle wherein the change of direction of transport of the sheet by the first and second guides totals about 75° to about 90°, the second concavely curved guide providing accumulation of the proper amount of sheet required to change the direction of transport of the sheet by the about 75° to about 90°.

8 Claims, 12 Drawing Sheets

MULTIPLE SUPPLY FILM TRANSPORT MECHANISM

FIELD OF THE INVENTION

This invention relates in general to transporting film between film supplies, optics and thermal processor assemblies in a medical laser imager.

BACKGROUND OF THE INVENTION

Known medical laser imagers have been designed with one or two film supplies.

One such imager is designed with a single film supply that utilizes a direct path to feed film from the film cartridge to the optics assembly. Since this machine has just one film supply, a single curved guide can be used to turn the film 90° degrees to re-direct the film towards the optics assembly. Another separate direct path is used to transport the film from the optics assembly to the thermal processor. Another such imager is also designed with a single film supply that utilizes a direct path to feed film from the film cartridge to the optics assembly. Another direct path is used to transport the film from the optics assembly to the thermal processor. A third such imager is designed with two film supplies. The lower film supply feeds film directly from the film cartridge to the optics assembly. The upper film supply feeds film into a transport assembly that feeds the film to the optics assembly. This same transport assembly is also used to feed film from the optics assembly to the processor.

Therefore, the current state-of-the-art in film transport is the use of separate direct feed paths in single film supply imagers. The two-film supply imager has a separate transport assembly that uses the same feed path to transport film from the upper film cartridge to the optics assembly and from the optics assembly to the thermal processor.

There is therefore a need for a film transport system for use in a medical laser imager having three film supplies such that any size film can be fed from any one of the three film supplies downwardly to an imaging assembly, and such that any size film can be fed from the imaging assembly up to a thermal processor located above the three film supplies.

SUMMARY OF THE INVENTION

According to the present invention, there is provided a solution to the problems of the prior art.

According to a feature of the present invention, there is provided an apparatus for changing the direction of transport of a sheet by about 75° to about 90° comprising:

a first flat guide for contacting the leading edge of a sheet transported along a path to change its direction of transport by an acute angle;

a second flat or concavely curved guide spaced from said first guide for contacting the leading edge of said sheet to change to direction of transport by an acute angle wherein the change of direction of transport of said sheet by said first and second guides totals about 75° to about 90°, said second concavely curved guide providing accumulation of the proper amount of sheet required to change the direction of transport of said sheet by said about 75° to about 90°.

ADVANTAGEOUS EFFECT OF THE INVENTION

The invention has the following advantages.

1. The film transport invention is a passive system that does not require components, such as film guides, to be moved out of the way for films from the middle or upper film supplies to pass through. A non-passive system with moving guides would significantly increase cost, complicate software development and reduce reliability due to additional moving parts.

2. The design includes a separate film path from the imaging assembly to the thermal processor to maximize throughput.

3. Film guides are designed to allow only the leading and trailing edges of the film to contact the guides while turning the film. In addition, guide rollers are designed to support the film during film turning. Both of these design elements prevent film scratching during film transport.

4. The geometry of the film turn guides are designed to accumulate the proper amount of film required to turn the film the required turn angle prior to entering the final roller. This is a key design feature in turning film through a desired angle.

DETAILED DESCRIPTION OF THE INVENTION

Figure 1A:
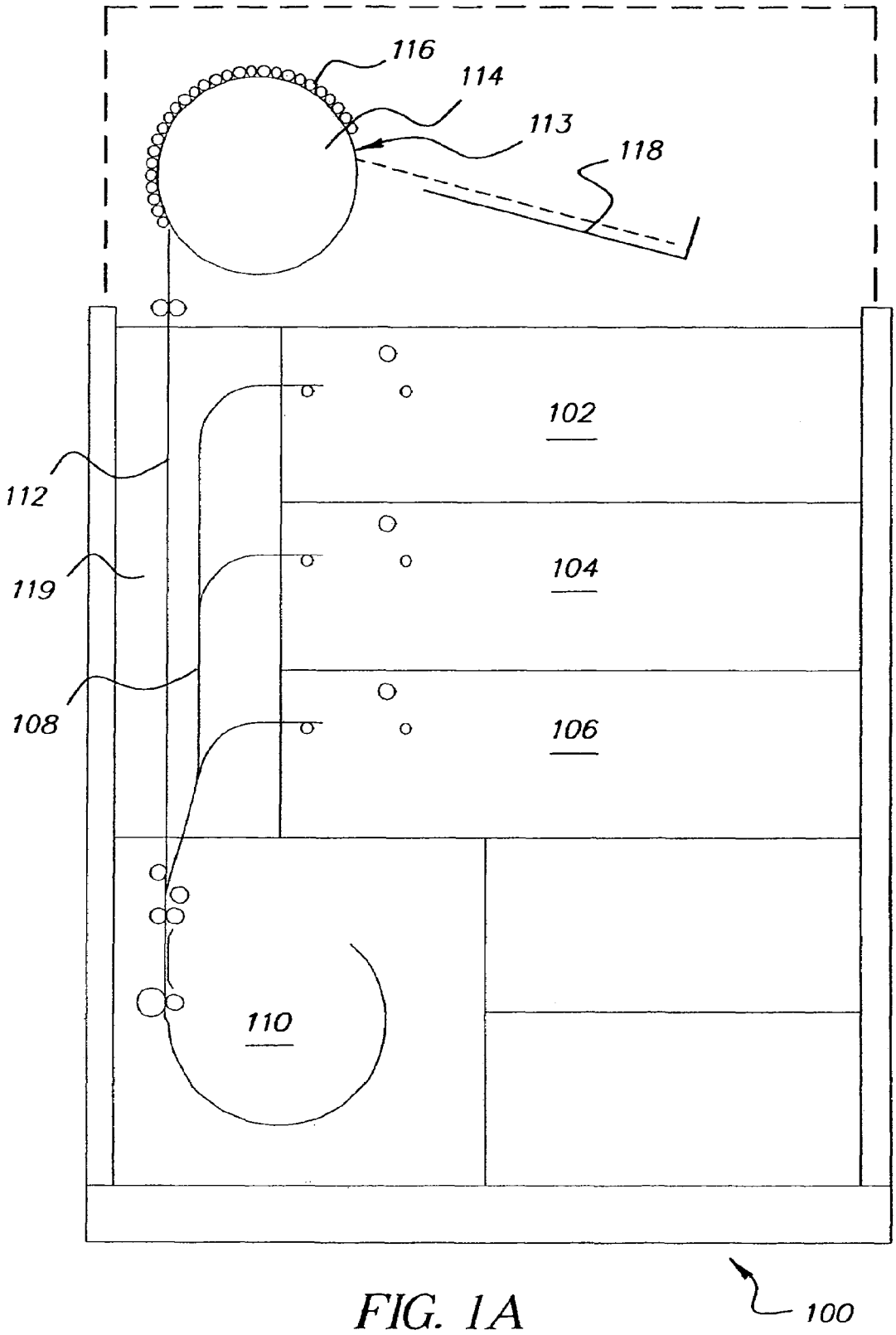
FIG. 1A is a diagrammatic view of a laser imager illustrating the film turning concept with the film pass-through capability from the previous film supply.

Referring now to FIG. 1A, there is shown a laser imager incorporating an embodiment of the present invention. As shown, laser imager 100 includes unexposed film supplies 102, 104, 106 for storing stacked sheets of unexposed heat processable film, preferably in removable film cartridges. Supplies 102, 104, 106 can receive film of the same or different sizes. Typically, each supply will receive film of different sizes. Individual sheets of film (such as x-ray film) are fed from one of supplies 102, 104, 106 to a down film path 108 to laser imaging region 110 where the unexposed film is exposed to an image (x-ray) by means of a (laser scanning assembly shown). The exposed film is transported up film path 112 to processor 113 which includes heated drum 114 and hold down rollers 116. The heat processed film is then transported to output tray 118 for removal by the user.

The primary challenge in transporting film from the imaging assembly 110 to the processor 113 is to retain the film as much as possible while still allowing access for film jam removal. A guide with an angled lead-in was developed to guide the film when transporting up to the processor 113.

Figure 1B:
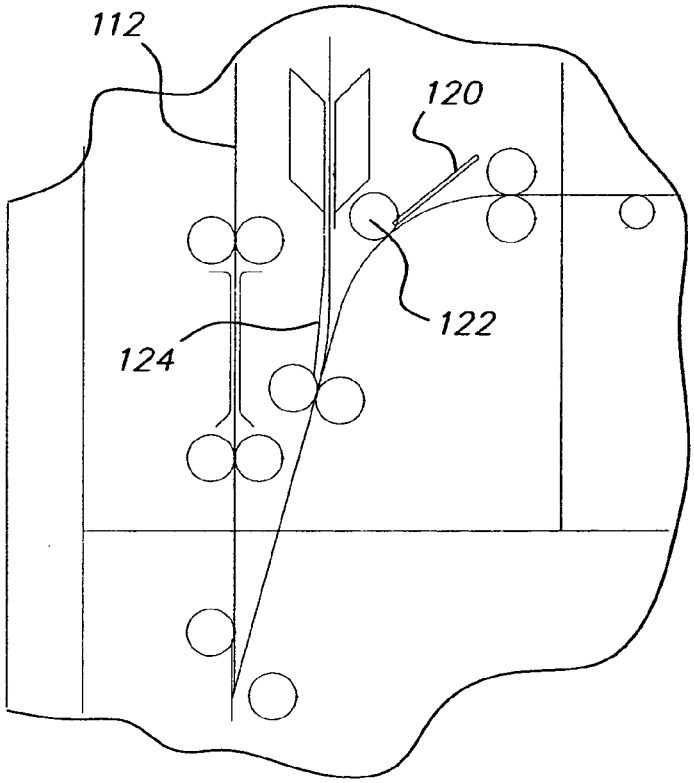
FIG. 1B is an exploded diagrammatic view of the film turning concept of FIG. 1A.

As discussed previously, the challenge in turning the film the required 75° to 90° is to develop a film turning mechanism that includes an open path for film to pass through from the middle and upper film supplies 102, 104. The goal in this design was to develop a passive system that did not require components, such as film guides, to be moved out of the way for films from the middle or upper film supplies to pass through. A non-passive system with moving guides would significantly increase cost, complicate software development and reduce reliability due to additional moving parts. A passive concept consisting of spring-loaded roller sets, drive rollers, and leading/trailing edge film guides was developed to turn the film. According to the invention as shown in FIG. 1B, an initial leading edge film guide 120 is designed to turn the film approximately 45°. Following this guide is a drive roller 122 that supports the film prior to contacting the secondary film guide 124. A roller is used to prevent the surface of the film from contacting the film guide. This is done to prevent film scratching. The secondary film guide 124 is designed to turn the film the remaining 30° to 45°.

Following is a description of the major components that make up the vertical transport assembly 119 including down film path 108 and up film path 112.

Figure 2:
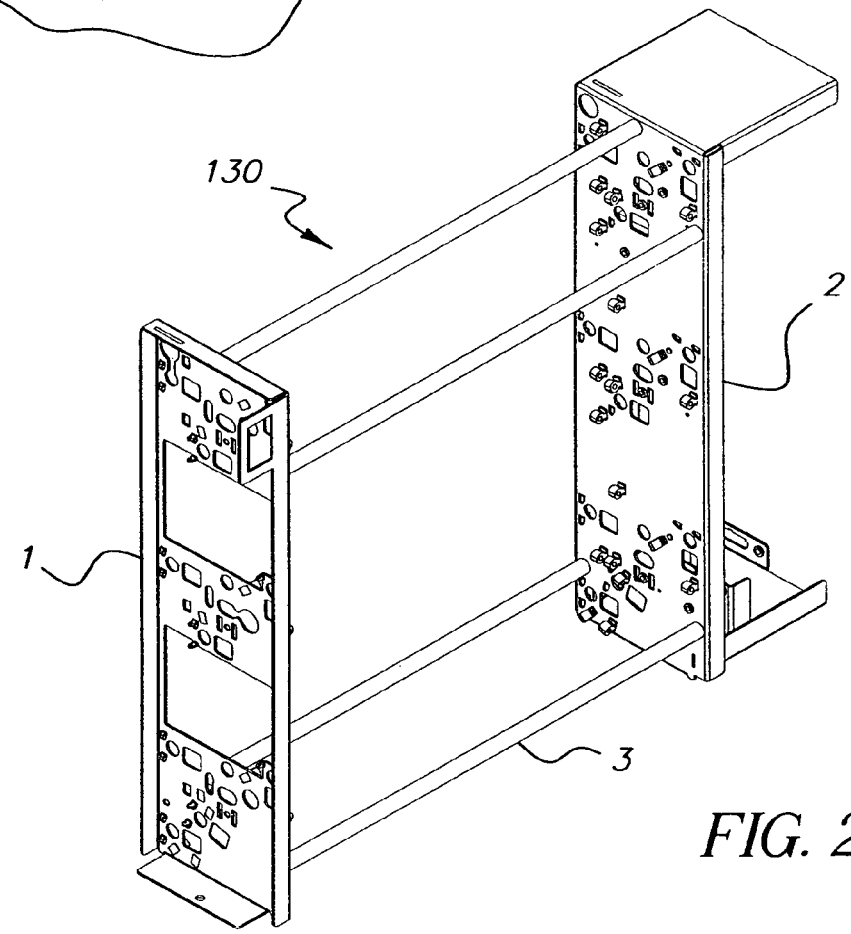
FIG. 2 is an isometric view of the assembled Vertical Transport frame with structural standoffs shown.

As shown in FIG. 2, the frame 130 is designed with a sheet metal front plate 1 and sheet metal back plate 2 separated and supported by cold rolled steel rod standoffs 3. This design approach was selected to provide a structurally rigid frame 130 capable of supporting a large number of rollers and guides. A design approach with separate front and back plates 1 and 2 also simplifies individual part shipping and handling due to smaller parts versus a complete welded style frame.

Figure 3:
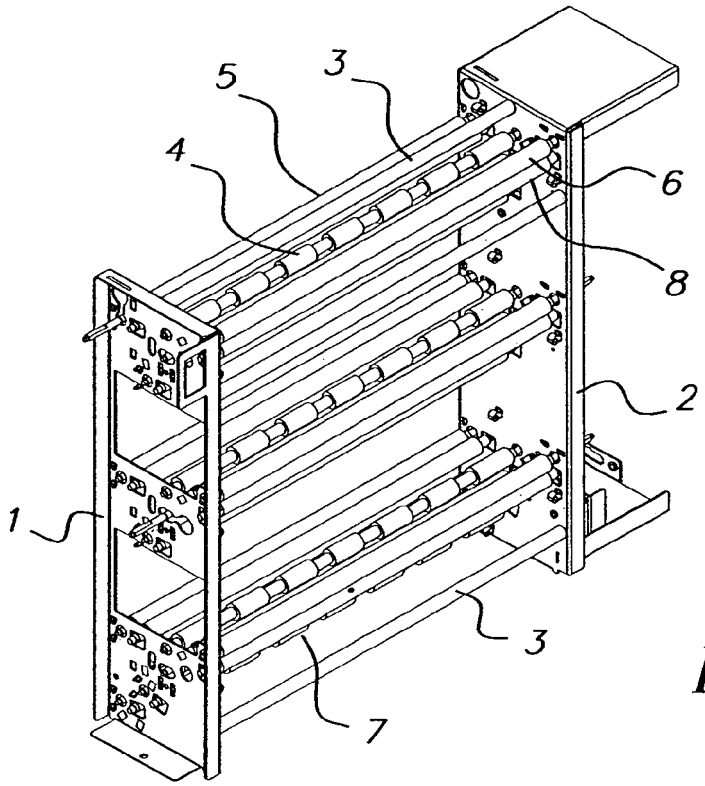
FIG. 3 is an isometric view showing the five unique types of film transport rollers utilized in an embodiment of the present invention.

There are several types of rollers required to transport film through the imager 100. The five types designed for the vertical transport assembly 119 are described below. These rollers are shown in FIG. 3.

segmented drive roller 4 solid drive roller with features for film advance knob 5 solid drive roller 6 segmented idler roller 7 solid idler roller 8

Figure 4:
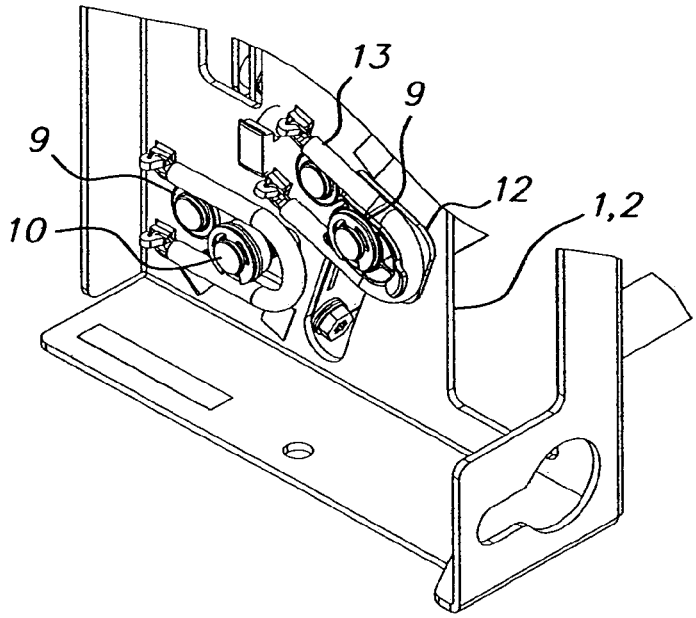
FIG. 4 is an isometric view showing the assembly method for the drive and idler rollers.

The two fundamental types of rollers used in film transport include drive rollers and idler rollers. The assembly of these rollers into the frame is described below and shown in FIG. 4.

A drive roller is placed in precision holes located in the front plate 1 and back plate 2 of the transport frame. A flanged, shielded, extended inner race ball bearing 9 is placed over the ends of the shaft of the drive roller 4, 5, 6 and inserted in the precision holes in front and back plates 1, 2. The bearing 9 is retained by an e-ring 10 inserted into a groove in the shaft of roller 4, 5, 6. The extended inner race bearing 9 was selected to prevent the e-ring 10 from contacting the bearing shield.

An idler roller 7, 8 is placed in the rectangular holes located in the front plate 1 and back plate 2 of the transport frame 130. A bearing retainer 12 is placed over the ends of the shaft of the idler roller 7, 8. A flanged, shielded, extended inner race ball bearing 11 is placed over the ends of the shaft of the idler roller 7, 8. The bearing retainer 12 and the bearing 9 are retained by an e-ring 10. An extension spring 13 is wrapped around the bearing retainer 12 and connected to the spring hook features located in front and back plates 1, 2. The bearing retainers 12 slide in the rectangular hole until the idler roller 7, 8 contacts the drive roller 4, 5, 6.

Figure 5:
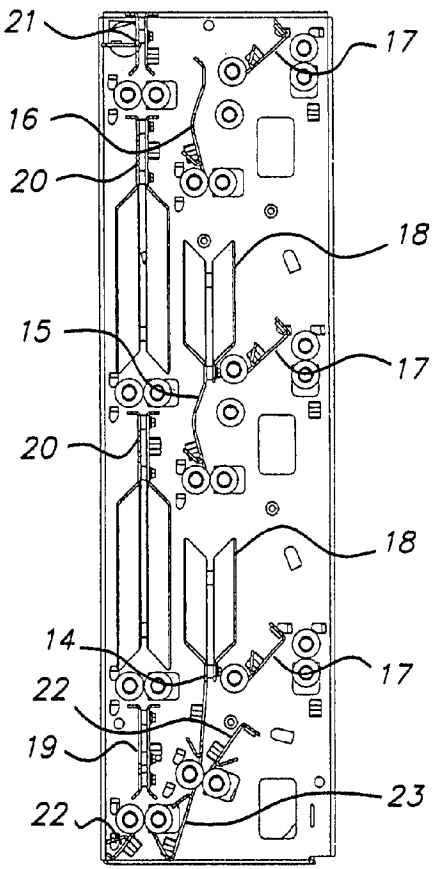
FIG. 5 is an elevational view showing the different types of film guides used in an embodiment of the present invention.

A number of different types of film guides are required to transport film through the vertical transport assembly 119. The types required are listed below and shown in FIG. 5.

lower down film guide 14 middle curved down film guide 15 upper curved down film guide 16 flat down film guide 17 right down film guide 18 lower up guide assembly 19 up guide assembly 20 sensor up guide assembly 21 flat segmented film guide 22 dual segmented film guide 23

The film transport drive train consists of stepper motors, drive pulleys, belt tensioners and timing belts. These components and their assembly to the vertical transport assembly 119 are described in the following sections and shown in FIG. 6.

A stepper motor 24 is attached to the back plate 2 for the down film transport 108 drive system. A second stepper motor 35 is attached to the back plate for the up film transport 112 drive system.

For drive trains with more than two pulleys a belt tensioning assembly is required. Two types are used in the vertical transport assembly 119. A flat tensioning assembly 25 is designed with an idler pulley for the flat side of the timing belt. This type is used in the lower film supply drive train and the top belt in the up film transport drive train. A grooved tensioning assembly 27 is designed with an idler pulley for the grooved side of the timing belt. This type is used in middle and upper film supply drive trains.

A flat idler 26 consists of a stationary shaft attached to the back plate 2 of the vertical transport assembly 119. This stationary idler 26 is used in the lower, middle and upper drive trains to create proper belt wrap around the drive pulley 28.

A number of timing belts are used in the vertical transport assembly 119 drive train. The six belts used are listed below.

lower film supply drive train (includes stepper motor 29)

middle film supply drive train 30A upper film supply drive train 30B lower film supply drive train 29 to middle film supply drive train 30A connection 31A middle film supply drive train 30A to upper film supply drive train 30B connection belt 31B input roller set 70 to roller set 72 connection belt 32 roller set 72 to roller set 74 connection belt 33 roller set 74 to roller set 76 connection belt (includes stepper motor 34)

Figure 7:
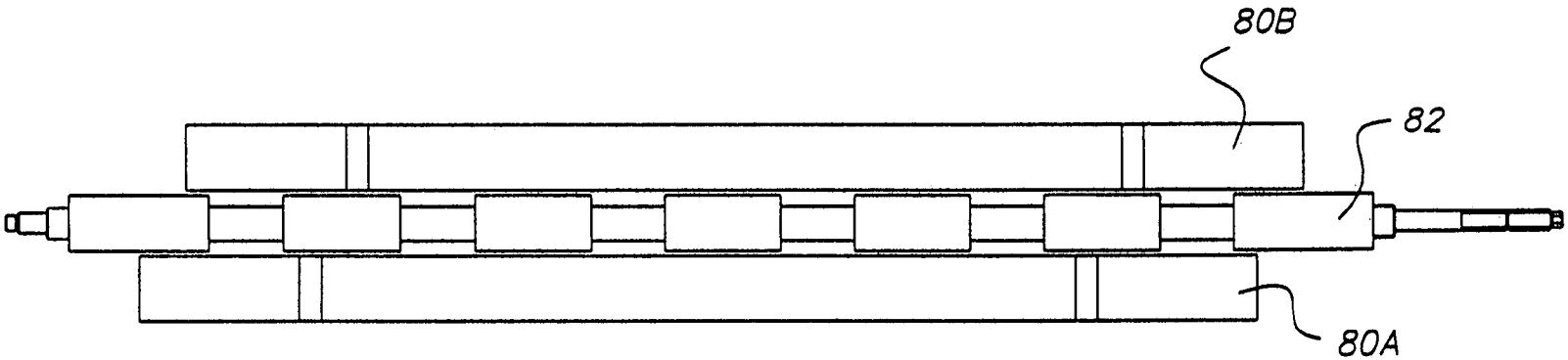
FIG. 7 is a diagrammatic view of how the different film sizes line up to a segmented roller.

A number of drive and idler rollers are segmented to provide a recessed area in the urethane material for film guides. The segments were designed to support the edge of the film for all possible film sizes. Film edge support was considered important due to the planned high-speed film transport. FIG. 7 shows the leading edge of the film 80A, 80B in relation to a segmented lower film transport roller 82. The possible film leading edge lengths include 35.5 cm, 25.4 cm, and 24 cm. The film edges are shown before 80A and after 80B the film is shifted 1.5 cm for film centering in the imaging assembly.

To transport film, the idler roller must be in contact with the drive roller with a certain amount of contact force. This contact force is created by spring loading the idler roller to the drive roller. A bearing retainer is designed to slide in a rectangular hole in the transport frame. An extension spring is wrapped around the bearing retainer and attached to spring hooks on the transport frame (see FIG. 4).

The guides utilized in transporting the film from the film supply to the imaging assembly are designed to guide the leading and trailing edges of the film while preventing the film surfaces from contacting the guides. The leading and trailing edge film guide approach is done to prevent scratches on the surface of the film. The guides are also fabricated from polished stainless steel to prevent scratching. Segmented guides are utilized to prevent scratching in the transition from film guide to roller. Without a segmented guide the first few millimeters of the leading edge of the film would be subject to scratching prior to contacting a urethane roller.

The guides utilized in transporting the film from the imaging assembly to the processor are designed to guide both side of the film as much as possible while leaving some free span areas for film jam access. The free span areas rely on the beam strength of the film to span the open area prior to entering a film guide. The up guides have an angled lead-in to help guide the film following a free span area.

Figure 6:
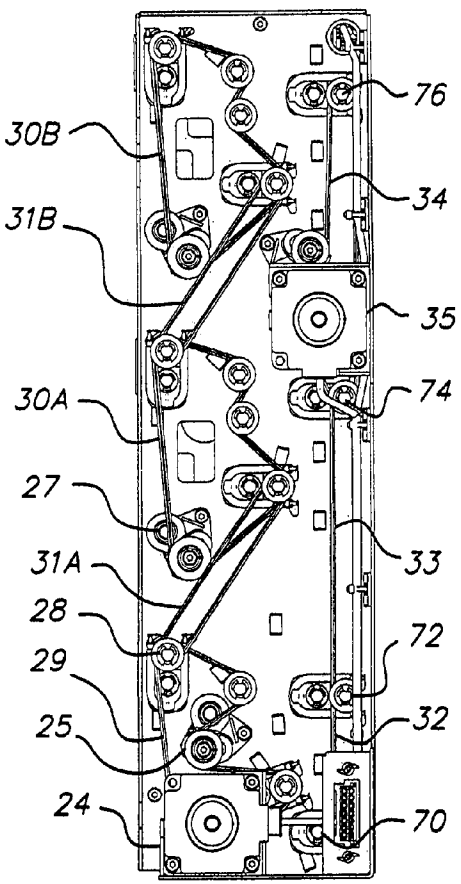
FIG. 6 is an elevational view showing motors, belts and other drive train components of an embodiment of the present invention.

To minimize torque requirements and the number of idler rollers, a multiple belt approach for the vertical transport assembly is shown in FIG. 6. For the down film transport, a single belt is used for the drive train components for each film supply. One belt length is required for the middle and upper film supply drive trains. An additional belt length is required for the lower film supply drive train due to the stepper motor. A third belt length is required to connect the lower film supply drive train to the middle film supply drive train. This same belt is used to connect the middle film supply drive train to the upper film supply drive train. Three additional belt lengths are used for the up film transport drive train.

The operations that occur as a film passes through the vertical transport assembly 119 are described below. Details on light tight, turning the film 75°–90°, leading and trailing edge guiding, and transporting the film up and down are described.

Figure 8:
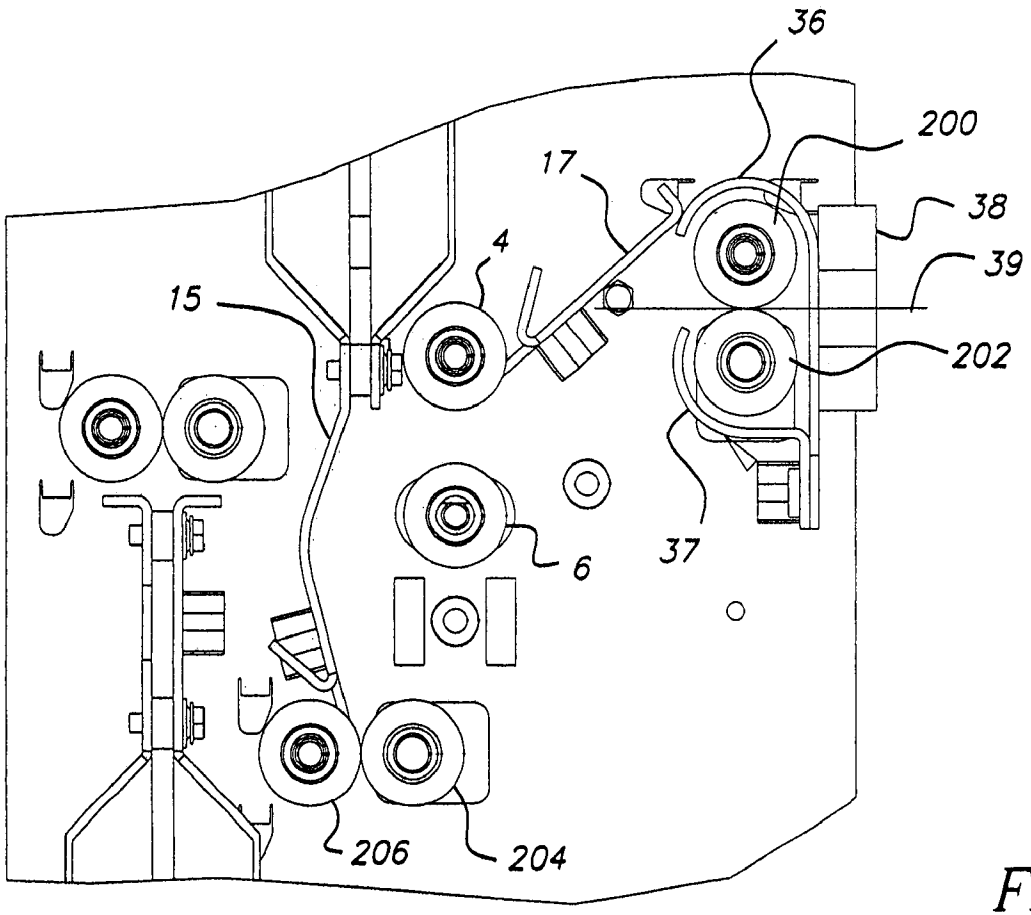
FIG. 8 is a partial elevational view showing an input roller set with covers that create light tight seal to film supply.

FIG. 8 shows an input roller set 200, 202 with a piece of film 39 entering a light tight seal which must be provided between the film supplies and the inlet to the vertical transport assembly 119. This is required to prevent ambient light from reaching an exposed film that is being fed into the processor 113. To provide this light tight seal a drive roller cover 36 and an idler roller cover 37 were designed to cover the input roller set 200, 202. The goal was to create a circuitous path to prevent light entering the vertical transport area of the machine. This circuitous light path is the gap between the roller and the inside surface of the roller cover. In addition, a film supply gasket 38 is attached to the frame to provide a seal around the inlet to the input roller set.

Figure 9:
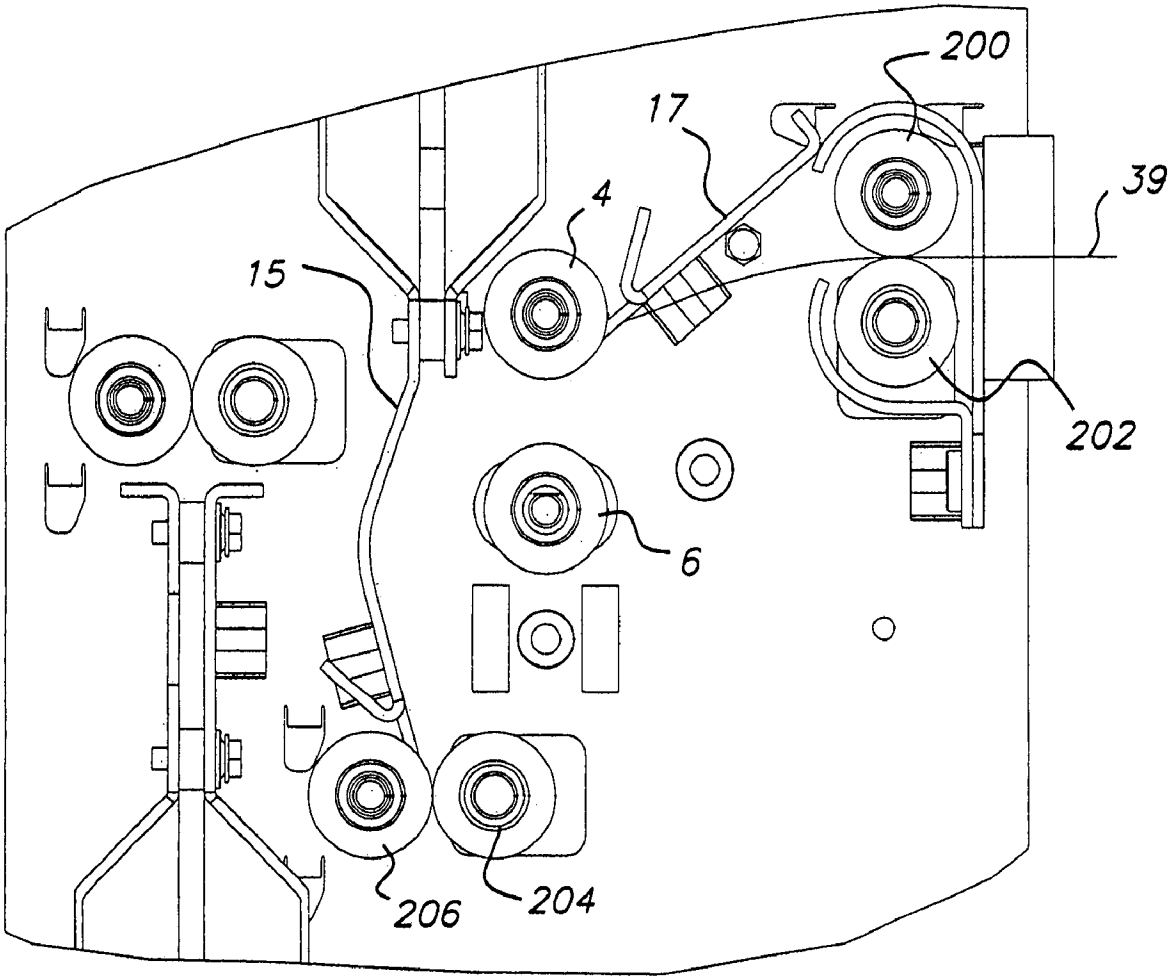
FIG. 9 is a partial elevational view showing a film contacting initial film guide.

The flat down film guide 17 is designed to provide a leading edge guide to start turning the film 39 as the film 39 is fed through the input roller set 200, 202. The film with an initial bend is shown in FIG. 9.

Figure 10:
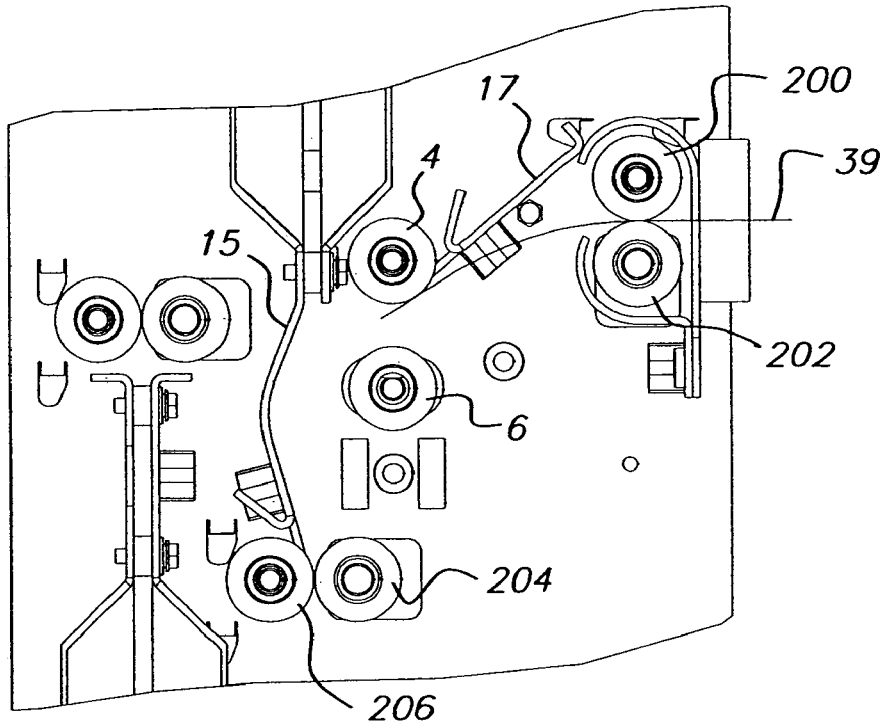
FIG. 10 is a partial elevational view showing film contacting initial segmented guide roller.

The segmented guide roller 4 is designed to support the film 39 after the leading edge of the film 39 leaves the flat down film guide 17. Both the flat down film guide 17 and the guide roller 4 are segmented. This allows the segmented tabs on the film guide 17 to be recessed into the corresponding recessed areas in the guide roller 4. With this designed, the film 39 can transition from the film guide 17 to the roller 4 without any contact between the film guide 17 and the surface of the film 39. This is done to prevent scratching on the film surface. The segmented guide roller 4 is a driven roller to match the speed of the film 39. This is done to prevent any scratching of the film 39 that could occur with a non-driven guide roller 4. The film 39 with an initial bend after the transition to the segmented guide roller is shown in FIG. 10.

Figure 11:
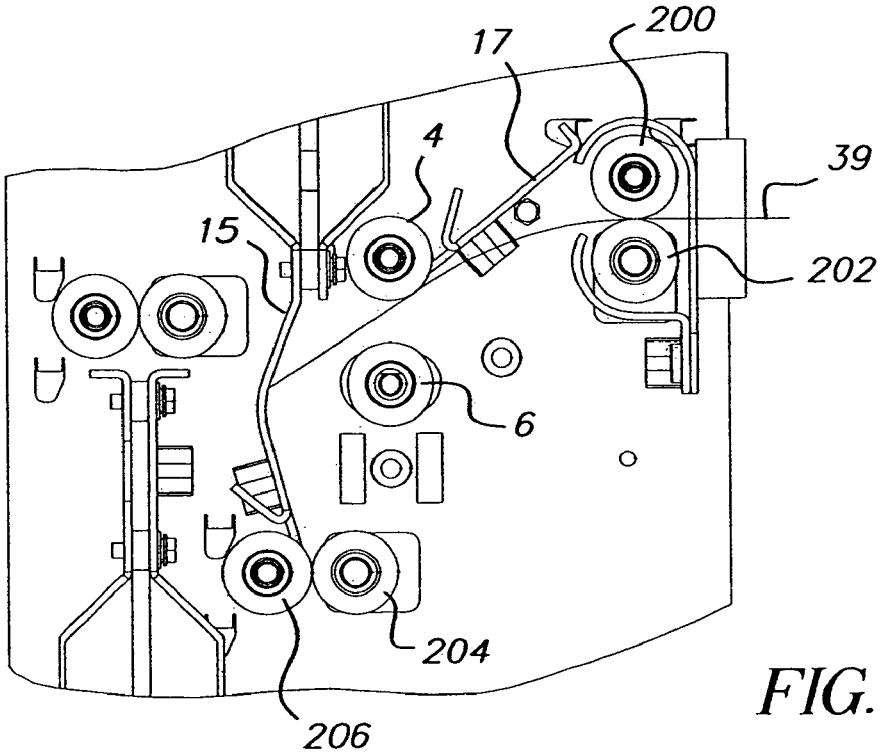
FIG. 11 is a partial elevational view showing film contacting curved film guide.

The middle curved down film guide 15 is designed to provide the next phase in the process of turning the film 39. The leading edge contacts the curved guide 15 to continue bending the film 39. The non-emulsion surface of the film 39 will remain in contact with the segmented guide roller 4. This phase of turning the film 39 is shown in FIG. 11.

Figure 12A:
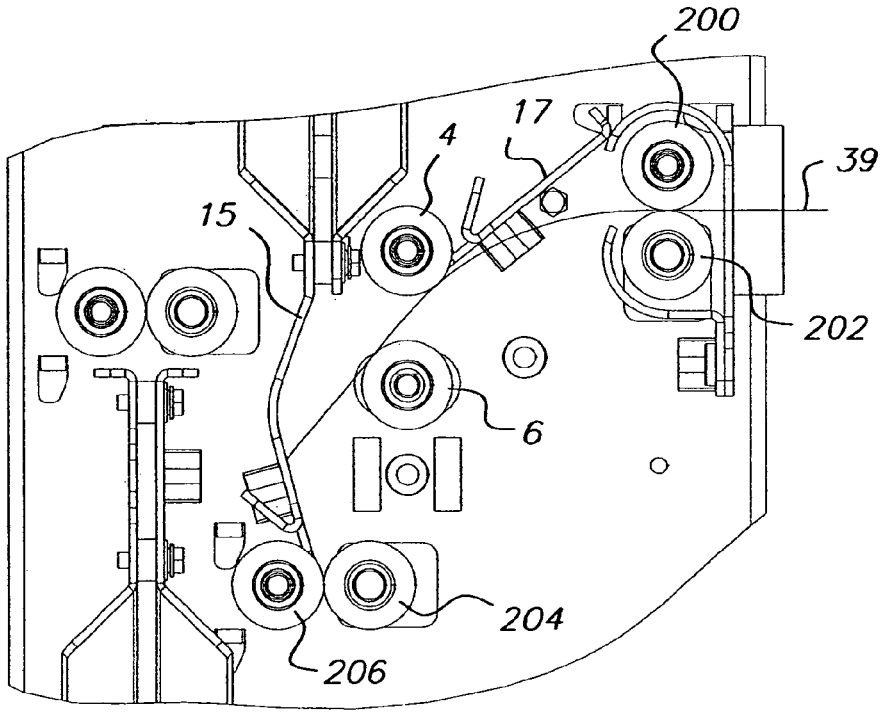
FIGS. 12A and 12B are partial elevational views showing film contacting secondary solid film roller.
Figure 12B:
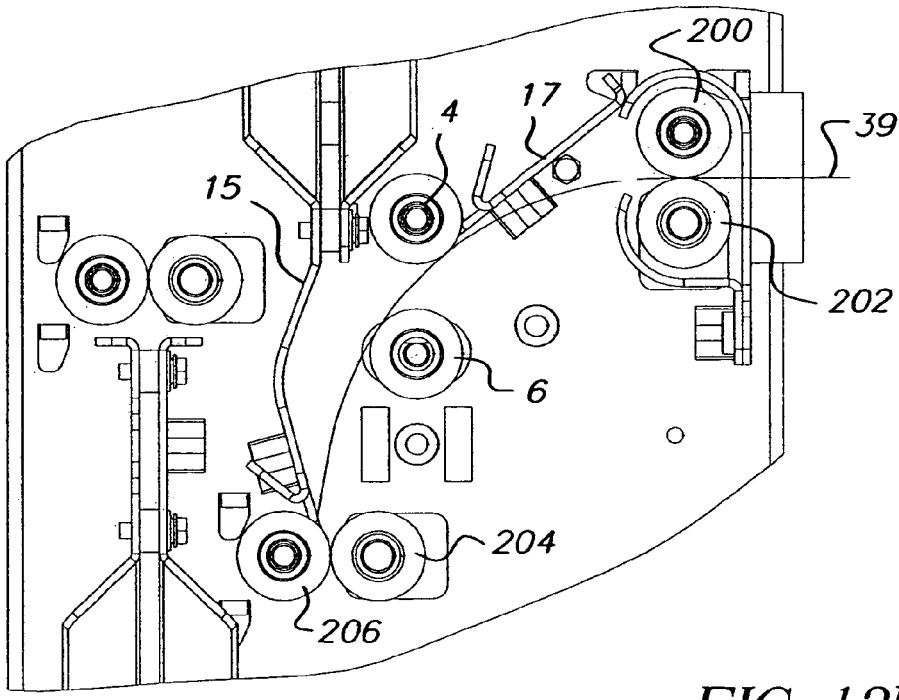

The solid drive roller 6 is designed to provide the next phase in the process of turning the film 39. As the leading edge of the film 39 slides along the middle curved down film guide 15, the emulsion side of the film will contact the solid drive roller 6. As the film 39 continues to be fed into the assembly, the contact with drive roller 6 will overcome the beam strength of the film 39 allowing the continued turning of the film 39. This solid drive roller 6 is driven to prevent any scratching of the film 39. This phase of turning the film 39 is shown in FIGS. 12A and 12B.

Figure 13:
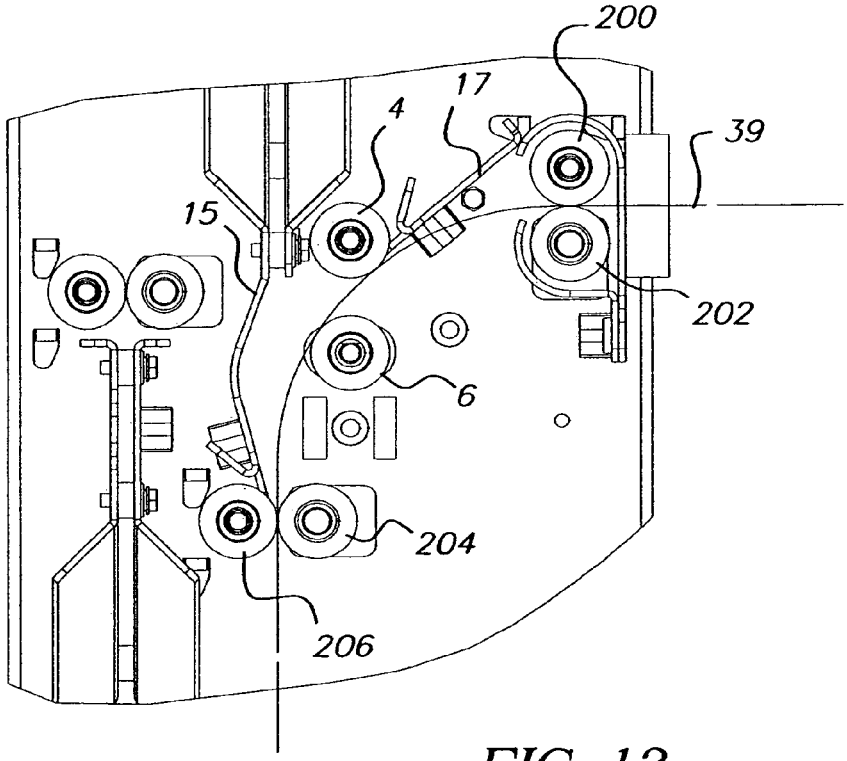
FIG. 13 is a partial elevational view showing film exiting outlet roller set after 90° film turn.

The curved leading edge film guide 15 is designed to provide enough accumulation of film 39 prior to the second roller set 204, 206 to result in a total film turn of 90°. If too little film 39 is accumulated prior to the leading edge of the film 39 entering the second roller set 204, 206, the film 39 will not be turned a full 90°. If too much film 39 is accumulated prior to the leading edge of the film 39 centering the second roller set 204, 206, the film 39 will be turned more than 90°. The film 39 exiting the second roller set 204, 206 after being turned 90° is shown in FIG. 13.

Figure 14:
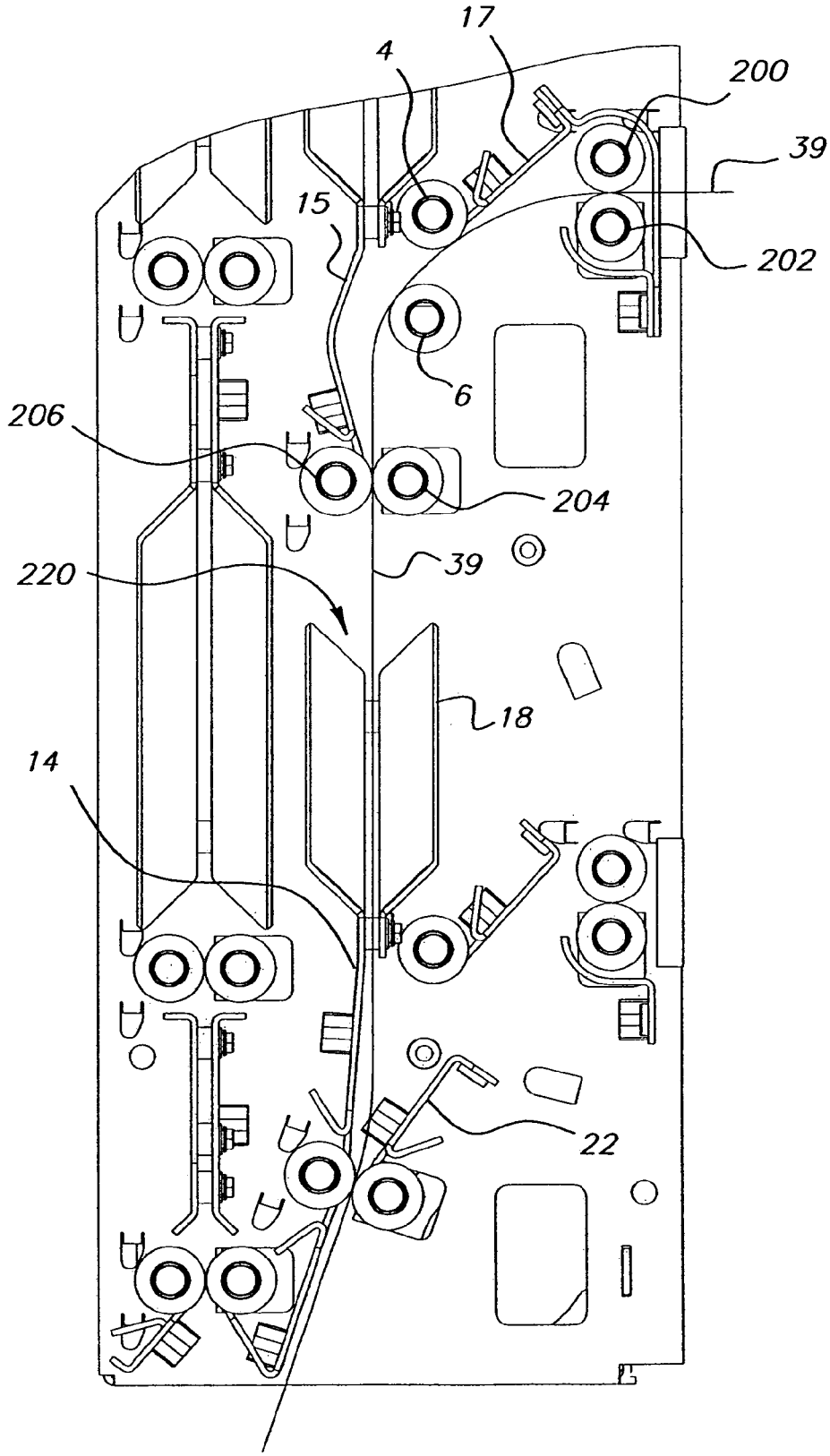
FIG. 14 is a partial elevational view showing film passing through lower film guides.

After the film 39 is turned 90°, it must continue down towards the imaging assembly 110. As the film 39 exits the second roller set 204, 206 the film 39 is unsupported for several inches prior to entering the lower set of film guides 14, 18. The film 39 has sufficient beam strength to span this distance while retaining its direction. This open span is required to provide access for film jam removal. After traveling unsupported for several inches, the film 39 enters the angled lead-in portion 220 of the lower curved down film guide 14 and the right down film guide 18. If necessary, the angled lead-in portion 220 of these guides 14, 18 direct the film 39 between the guides 14, 18. After passing between these two guides 14, 18 the leading edge of the film 39 will contact the flat segmented film guide 22. The film 39 is shown passing through the two film guides 14, 18 and contacting the flat segmented film guide 22 in FIG. 14.

Figure 15:
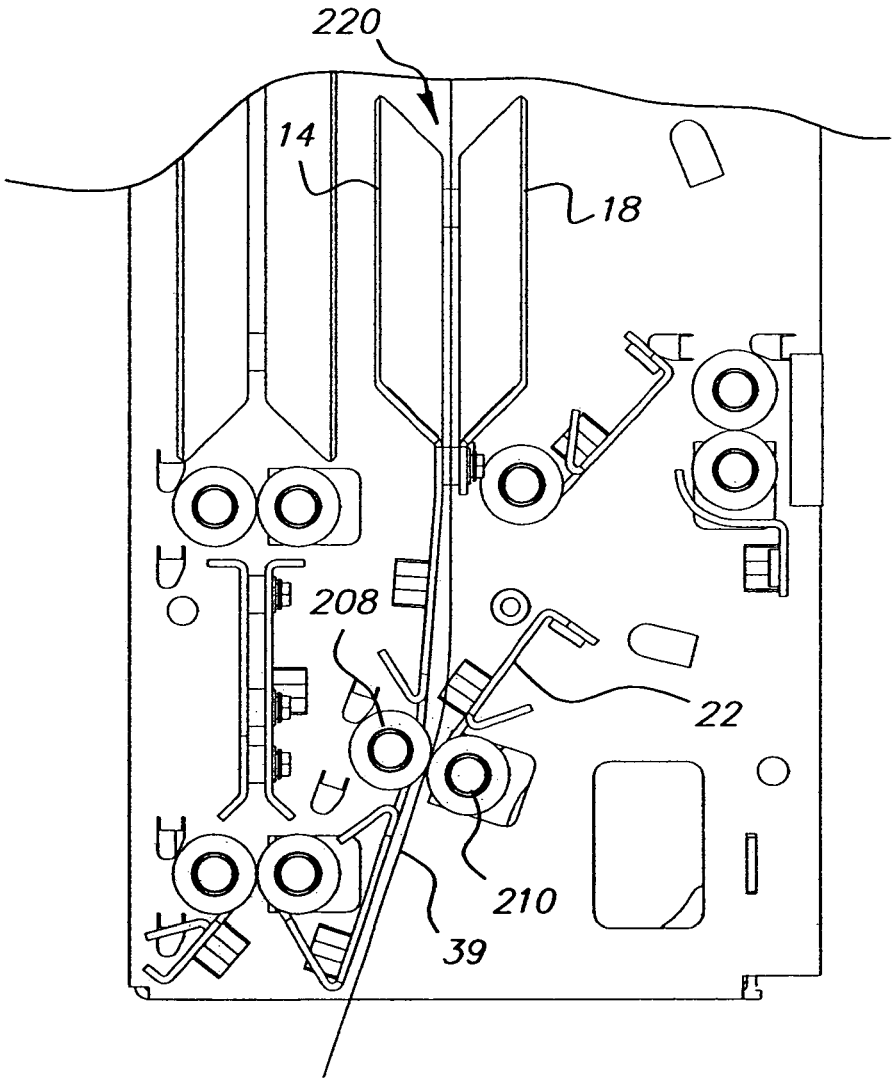
FIG. 15 is a partial elevational view showing film after final turn towards imaging assembly.

The flat segmented film guide 22 is a leading edge film guide designed to turn the film 39 15° from vertical to direct the film 39 towards the Imaging Assembly 110. After sliding along this film guide 22 the film 39 will enter the final roller set 208, 210 prior to entering the imaging assembly 110. This film guide 22 is located to accumulate the proper amount of film 39 prior to entering the roller set 208, 210. The film 39 is shown in the final roller set 208, 210 15° from vertical in FIG. 15.

The invention has been described in detail with particular reference to certain preferred embodiments thereof, but it will be understood that variations and modifications can be effected within the spirit and scope of the invention.

PARTS LIST

1 front plate
2 back plate
3 steel rod standoffs
4 segmented drive roller
5 solid drive roller with features for film advance knob
6 solid drive roller
7 segmented idler roller
8 solid idler roller
9 extended inner race bearing
10 e-ring
12 bearing retainer
13 extension spring
14 lower down film guide
15 middle curved down film guide
16 upper curved down film guide
17 flat down film guide
18 right down film guide
19 lower up guide assembly
20 up guide assembly
21 sensor up guide assembly
22 flat segmented film guide
23 dual segmented film guide
24 stepper motor
25 flat tensioning assembly
27 grooved tensioning assembly
28 drive pulley
29 lower film supply drive train
30A middle film supply drive train
30B upper film supply drive train
31A connection
31B connection belt
32 connection belt
33 connection belt
34 stepper motor
35 second stepper motor
36 drive roller cover
37 idler roller cover
38 film supply gasket
39 film
70 input roller set
72 roller set
74 roller set
76 roller set
80A leading film edge
80B shifted film edge
82 film transport roller
100 laser imager
102 unexposed film supplies
104 unexposed film supplies
106 unexposed film supplies
108 film path
110 laser imaging region
112 film path
113 processor
114 heated drum
116 down rollers
118 output tray
119 vertical tray assembly
120 leading edge film guide
122 drive roller
124 secondary film guide
126 second roller set
130 frame
200 input roller set
202 input roller set
204 second roller set
206 second roller set
208 final roller set
210 final roller set
220 angled lead-in portion

What is claimed is:

1. Apparatus for changing the direction of transport of a sheet by about 75° to about 90° comprising:

a first flat guide for contacting the leading edge of a sheet having a sheet surface transported along a path to change its direction of transport by an acute angle; and a second flat or concavely curved guide spaced from said first guide for contacting the leading edge of said sheet to change its direction of transport by an acute angle wherein the change of direction of transport of said sheet by said first and second guides totals about 75° to about 90°, said second guide having a curved segment providing accumulation of the proper amount of sheet required to change the direction of transport of said sheet by said about 75° to about 90°, wherein said first and second guides only contact the leading edge of said sheet.

2. The apparatus of claim 1 including a first single driven roller located adjacent to an end of said first guide for transporting said sheet towards said second guide, said roller preventing contact of said sheet surface with said first guide.

3. The apparatus of claim 2 wherein said first single roller is segmented and said first guide is segmented to fit into the recesses of said segmented first roller to assist in transitioning said sheet from said first guide to said first roller without any contact between the surface of said sheet and said first guide.

4. The apparatus of claim 2 including a second single driven roller, spaced from said second guide and located below said first single roller, for contacting the surface of said sheet as it is guided by said second guide to assist in overcoming the beam strength of said sheet to allow the continued turning of said sheet.

5. Film transport apparatus comprising:

a first driven roller set for transporting a film having a film surface along a horizontal path;

a second driven roller set spaced laterally and downwardly from said first roller set for transporting said film along a vertical path; and a film guide assembly for guiding said film between said first and second roller sets, said assembly including a first flat guide positioned to contact the leading edge of a film transported horizontally by said first roller set to change its direction of transport at an acute angle;

a first driven guide roller located adjacent to an end of said first guide for transporting said film towards a second guide, said roller preventing contact of said film surface with said first guide;

a second flat or concavely curved guide spaced from said first guide for contacting the leading edge of said film to change its direction of transport by an acute angle, wherein the change of direction of transport of said film by said first and second guides totals about 75° to 95°, said second flat or concavely curved guide providing accumulation of film required to change the direction of transport of said film by about 75° to about 90° to a vertical direction into said second driven roller set; and a second driven guide roller spaced from said second guide and located below said first guide for contacting the surface of said film as it is guided by said second guide to assist in overcoming the beam strength of said film to allow the continued turning of said sheet;

wherein during transport of said film by and between said first and second driven roller sets, only the leading and/or trailing edges of said film come into contact with said first and second guides.

6. The apparatus of claim 5 wherein said first roller is segmented and said first guide is segmented to fit into the recesses of said segmented first roller to assist in transitioning said film from said first guide to said first roller without any contact between the surface of said film and said first guide.

7. The apparatus of claim 5 wherein said first and second rollers and said first and second roller sets are driven at the same speed to prevent any scratching of the film.

8. The apparatus of claim 5 including a third driven roller set spaced above said horizontal path and in substantial vertical alignment with said second driven roller set for transporting film along a path from said third driven roller set to said second driven roller set.

* * * * *